US005195061A

United States Patent [19]

Curtis et al.

[11] Patent Number: 5,195,061

[45] Date of Patent: Mar. 16, 1993

[54] PRACTICE TIMER

[76] Inventors: Erin M. Curtis; Marshall M. Curtis, both of 9506 Arnon Chapel Rd., Great Falls, Va. 22066

[21] Appl. No.: 684,572

[22] Filed: Apr. 12, 1991

[51] Int. Cl.[5] ..... G04F 8/00; G04B 47/06; G08B 13/18

[52] U.S. Cl. ..... 368/9; 368/11; 368/113; 340/540; 340/654; 84/484

[58] Field of Search ..... 368/9-11, 368/107-113; 84/484; 340/540, 541, 570, 691, 654

[56] References Cited

U.S. PATENT DOCUMENTS 3,689,839 9/1972 Cother ..... 368/113
4,725,996 2/1988 Marble et al. ..... 368/9
4,797,663 1/1989 Rios ..... 340/691
5,124,960 6/1992 Miller et al. ..... 368/278

*Primary Examiner*—Vit W. Miska
*Attorney, Agent, or Firm*—Whitham & Marhoefer

[57] ABSTRACT

A timer for measuring time spent productively in an activity, with a minimum of interference with the activity, which includes a sensor and a delay circuit. The delay circuit compensates for productive time spent in an intermittent activity which may not result in the production of energy to which the sensor is responsive, as often occurs, for instance, during the practice of performing arts. Sensors preferably are responsive to energy which can be conducted through the atmosphere, such as sound and visible light. The timer may be fabricated as a free-standing unit, included within an electronic metronome or functionally combined with a variety of equipment.

10 Claims, 2 Drawing Sheets

PRACTICE TIMER

BACKGROUND OF THE INVENTION

1. Field of the Invention

The present invention generally relates to interval timers and, more particularly, to a timer for measuring the duration of an activity, such as the practice on a musical instrument, even though the activity may be intermittent.

2. Description of the Prior Art

The accurate measurement of time has been central to many kinds of human activity. In early times, candles and containers which would allow the flow of a fixed amount of fluid or pulverent material through an aperture were ways of providing a relatively consistent indication of a predetermined interval. In modern times, although the so-called egg timer (a form of hour-glass) is still in widespread use, clockwork mechanisms as well as electronic (e.g. quartz) time bases have been developed for the indication of the lapse of a predetermined interval. However, such devices are not easily related to a particular activity unless they are also used to control that activity. Therefore, the most common application of such timers is to processes (e.g. cooking) or dispensing (e.g. lawn sprinklers) which typically proceed independently for a predetermined period when control by an operator is not anticipated.

So-called stop watches have allowed the extremely accurate measurement of the duration of an activity and can be provided with complex controls, such as so-called lap or split time indications so that a duration of a portion of a continuing activity can be observed while the measurement of the duration of the continuing activity remains ongoing. Such devices often include a provision by which the measurement can be halted for an arbitrary time and then resumed so that the cumulative time spent in the performance of an intermittent activity can be measured, independently of the interval during which the intermittent activity occurred.

However, stop watches require the active control of an operator and are ill-suited to use by the person performing the activity. They are also inaccurate to the extent that the operator's ability to control the stop watch is also inaccurate, particularly when the operator must actuate the timer, begin the activity, cease the activity, control the timer, etc. Thus they can substantially interfere with the performance of the activity unless special actuation arrangements are provided to provide actuator switches which are convenient to the activity, such as touch pads for swimming or light beam interruption for other athletic events.

It has been found by the inventor that these shortcomings of the prior art are particularly onerous as applied to activities or events which are associated with artistic expression or practice therefor, particularly since the manual operation of a timing device interferes with the mental concentration necessary to effectively conduct the activity. Further, especially as applied to the practice of music, the physical movements involved in the activity are irregular or subtle and cannot be easily sensed to control a timer. Also, while music practice is a training activity, not unlike athletic endeavors in some respects, the necessity for accuracy of cumulative elapsed time during which the activity is performed is even more critical since more subtle injuries may occur through overwork. Conversely, since music practice, by its nature, is extremely intermittent, the use of a timer which is not accurately controlled and merely measures the practice period can be very misleading as to the training effect of the practice and encourages bad and inefficient practice habits since time wasted during the practice period is not distinguished from actual practice time.

SUMMARY OF THE INVENTION

It is therefore an object of the present invention to provide a cumulative timer for measuring the duration of a possibly intermittent activity.

It is another object of the present invention to provide an arrangement for control of a timer based on the result of the activity to be timed and which will thereby avoid accumulation of nonproductive time spent in the activity.

It is a further object of the invention to provide a timer particularly adapted for the practice of a performance skill which will encourage good study and practice habits.

To achieve the foregoing and other objects of the invention, there is provided an activity timer for accumulating elapsed productive time spent engaged in the activity including a sensor capable of sensing variation in atmosphere-carried energy for sensing a result of said activity, a time base for producing periodic signals, an accumulator for accumulating the periodic signals from said time base, a switch responsive to said sensor, including a delay, for interrupting transmission of the periodic signals from the time base to the accumulator during periods delimited by a predetermined output of the sensor and a predetermined delay period after another predetermined output of said sensor means.

In accordance with another aspect of the invention, there is provided a method of measuring time duration of productive effort during an activity including the steps of sensing a predetermined form of energy produced by said productive effort of said activity, establishing a predetermined time period during which productive effort will not produce said predetermined form of energy, and accumulating elapsed time during the sum of a duration of said sensing step and said predetermined time period.

In accordance with a further aspect of the invention, an electronic metronome or other device is provided with a timer including a sensor capable of sensing variation in atmosphere-carried energy for sensing a result of said activity, a time base for producing periodic signals, an accumulator for accumulating the periodic signals from said time base, a switch responsive to said sensor, including a delay, for interrupting transmission of the periodic signals from the time base to the accumulator during periods delimited by a predetermined output of the sensor and a predetermined delay period after another predetermined output of said sensor means.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
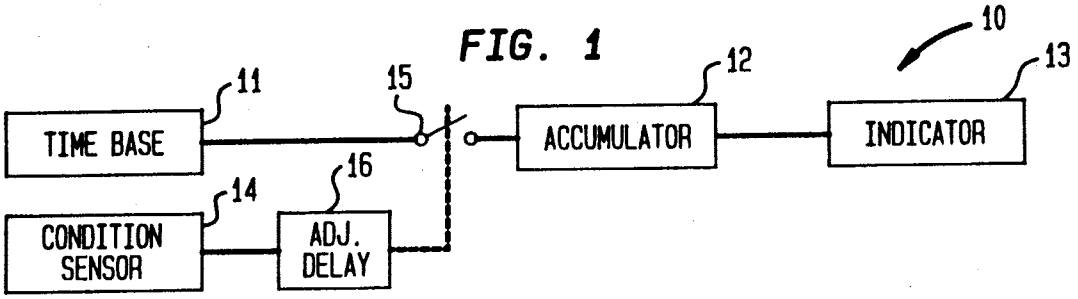
FIG. 1 is a block diagram of the invention.

Referring now to the drawings, and more particularly to FIG. 1, there is shown a block diagram of a basic form of the invention. Essentially, the practice timer 10 according to the invention comprises a time base 11, an accumulator 12, an indicator 13, a condition sensor 14, most preferable responsive to sound for the purpose of performing arts practice, and an interruption means 15, which may simply comprise a switch, which is responsive to the condition sensor to interrupt the output of the time base. An adjustable delay 16 is imposed on the control of interruption means 15 in response to condition sensor 14.

This adjustable delay is important to the invention to avoid a minor or apparent hiatus in the sensed condition from interrupting the operation of the timer. For instance, a caesura or fermata in music being practiced might result in a seeming interruption in sound which is sensed but might not represent any interruption of the musical composition being practiced or the practice time which should be accumulated by the timer. In practice, it has been found desirable to provide adjustment of the time delay since resonant musical instruments, such as the piano will produce sound well beyond the last keystroke and would warrant a relatively short delay, where wind and some other string (e.g. the banjo) and percussion instruments, being less resonant, may justify a slightly longer delay. Dramatic speech and other applications may warrant yet longer delays as will be detailed below.

The most important feature of the present invention is that, by virtue of the combination of the condition sensor and the delay, the timer according to the invention is automatically responsive to the productive result of the activity within a very good approximation and is arranged to be adaptable to a wide variety of activities to accurately register the productive time spent in the pursuit thereof without serious interference or distraction to the activity. By registering only the period of productive effort, the cumulative productive time will be compared by the user to the elapsed chronological time and will thus produce an incentive for more productive use of time. In other words, if it is desired to accomplish one-half hour of productive piano practice or other activity, on an early use of the present invention, an hour or more of chronological time may be required. The amount of non-productive time will become apparent and the user will endeavor to reduce the amount of chronological time consumed in the attainment of the goal of a predetermined amount of productive time for practice or study. The invention can also be simply arranged to measure non-productive time directly, which may be of use to teachers and parents in counseling students to make more productive use of practice or study time, as will be explained in greater detail below.

Figure 2:
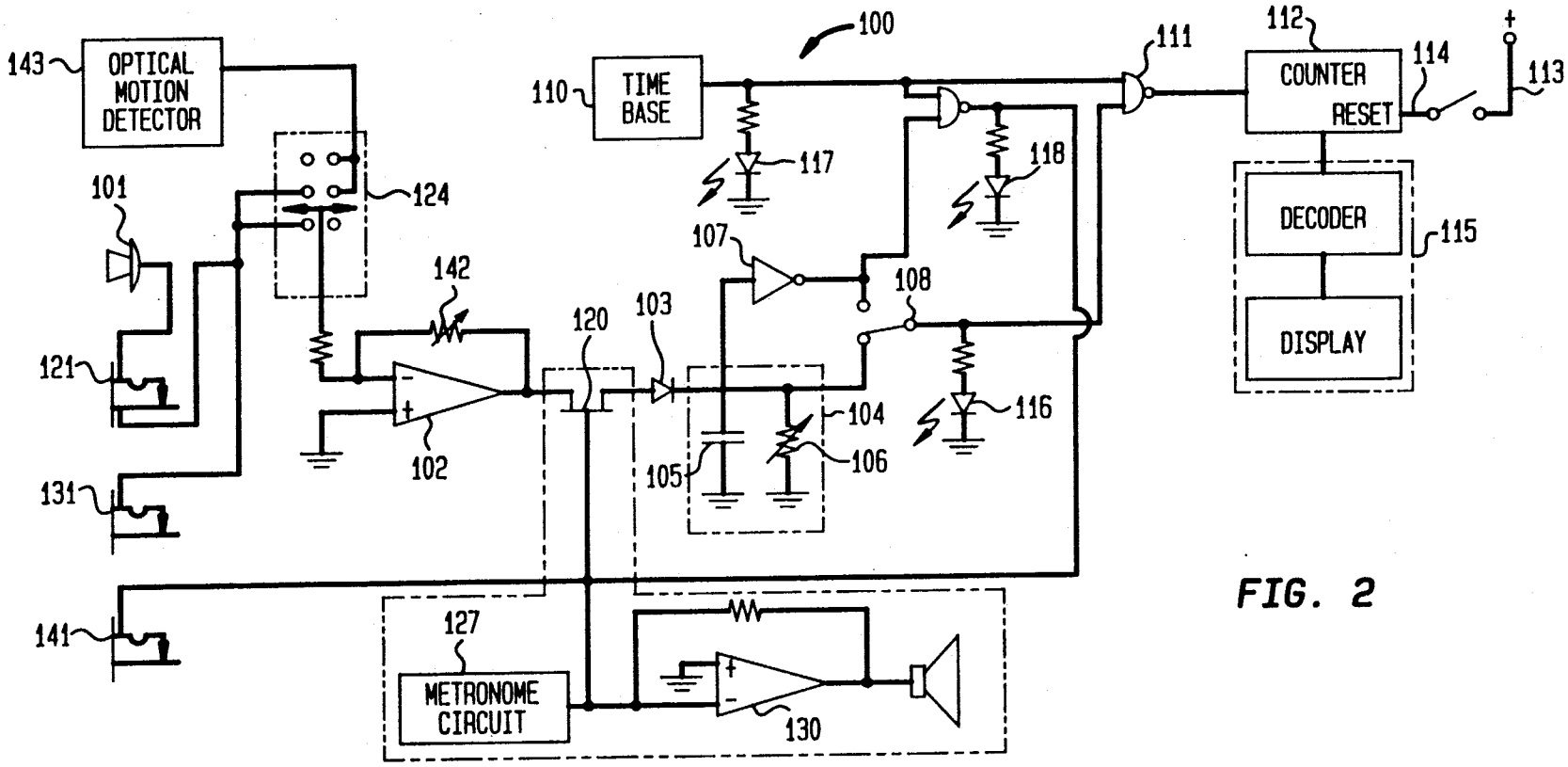
FIG. 2 is a schematic diagram of a preferred embodiment of the invention shown in FIG. 1.

Referring now to FIG. 2, a preferred embodiment of the invention is shown in greater detail. Timer 100 includes a microphone 101, which may be an inexpensive and miniature type and amplifier 102, which can be a readily available operational amplifier such as the 741 type. Amplifier 102 is preferable arranged for relatively high gain, which can also be made adjustable by use of variable feedback resistor 142 in accordance with any of many circuits known in the art. The output of amplifier 102 is fed through diode 103 to an RC circuit 104. Switch 120 will be described below and can be considered as a hard-wire connection at this point in the discussion of the basic operation of the invention.

The RC circuit 104, as indicated above, is made to have a variable time constant by means of capacitor 105 and variable resistor 106. It is preferable that the time constant be variable over a range of at least one to thirty seconds. It is deemed preferable that the capacitance be kept fairly small due to the miniaturization of the overall device, quick response to the commencement of the sensed activity and to reduce power consumption and output demands on the operational amplifier 102. Consequently, the resistance should be fairly large and it is contemplated that the preferable resistance should be in excess of 1 Megohm, provided by a fixed resistor and a 50 Megohm potentiometer. As resistance is raised, however, the input capacitance and resistance of downstream circuitry may need to be considered as it becomes comparable to the value of the capacitance 105. For this reason, the use of CMOS circuitry is deemed preferable, due to its high input impedance and relatively high input capacitance, which can be used to supplement or possibly replace capacitor 105, saving expense and space.

The output of the RC delay circuit 104 is fed to a switch 108 and to the input of an inverter 107, which also provides its output to an input of switch 108. The use of an inverter 107 and switch 108 allows switching between a measurement of productive time and non-productive time. For example, if switch 108 is set to receive the output of inverter 107, only time when no productive activity is sensed, beyond the delay, will be accumulated.

Figure 3:
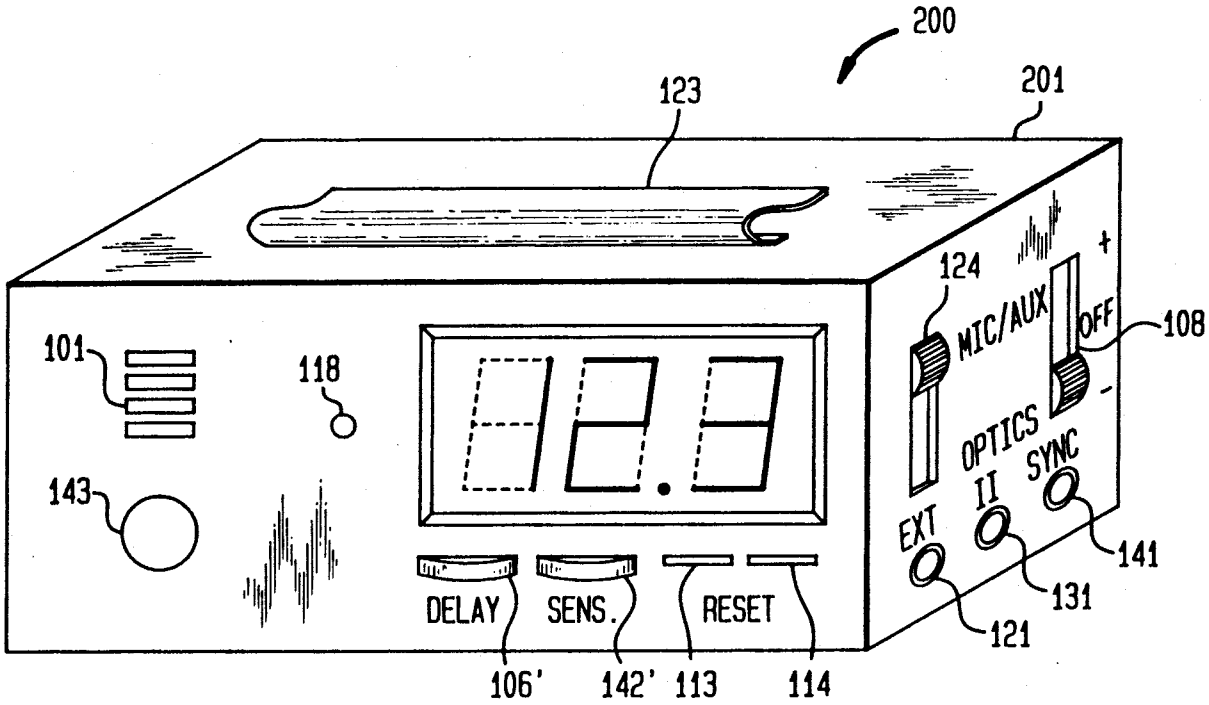
FIG. 3 is a view of an exemplary construction of the invention.

Control of time accumulation is provided by NAND gate 111 which, if the input from switch 108 is high, conveys pulses from time base 110 to counter 112. This gate can take many forms as will be apparent to those skilled in the art, so long as its function corresponds to that of interruption means 15 of FIG. 1. When enabled by an output of RC circuit 104, whether or not inverted by inverter 107, counter 112 will receive pulses from free-running time base 110, which will be accumulated by counter 112 until reset by a potential applied to a reset electrode thereof from terminal 113 to line 114, connected thereto, preferably by a body conductance switch, as shown in FIG. 3.

The output of counter 112 is preferably arranged to convey BCD signals over sixteen conductors to a decoder and display 115, such as a three digit display or possibly over seventeen conductors for a three and one-half digit display. If a three digit display is used, the accumulation can reach 99.9 minutes or over one and one-half hours, which is deemed sufficient for most of the anticipated uses. If a three and one-half digit display is used, 199.9 minutes, or nearly three and one-half hours can be accumulated.

It is anticipated that a greater display capacity will not be required and that tenths of a minute will provide sufficient accuracy for common use of the invention. The reason for this is that, for musical practice, it is anticipated that a delay provided by delay circuit 16 will be approximately 5–6 seconds and an indication of tenths of a minute will provide adequate indication of functionality of the timer to allow all adjustments to be carried out. Alternatively, one or more indicators, such as LEDs, can be placed in the circuit at locations shown at 116, 117 and 118 for this purpose. If such indicators are provided, it may only be necessary to provide a two or two-and-one-half digit display, thereby reducing cost of the unit.

The use of LED 118 with a NAND gate 119 is deemed particularly advantageous, particularly if a time base 110 frequency of about one second is provided, as can be done with a type 555 timer and other components of very small size. In such a case, the LED 118 will flash when the output of inverter 107 goes high (e.g. after time-out) to allow adjustment of the delay 16 and, in use, will flash during non-productive periods to alert the user to resume productive effort.

Referring now to FIG. 3, the overall device 100, fabricated as a free-standing unit 200 is shown in a preferred form. Housing 201 is provided to contain the circuit of FIG. 2 and can be fabricated to have dimensions as desired. As a free-standing unit, it is anticipated that a maximum of about three to four cubic inches will be required to include the circuitry, battery and display, even if only inexpensive CMOS gate arrays, counters and decoders are used. Of course, the device could be made much smaller if application specific integrated circuits (ASICs) are used.

The number of controls which are desirable for the device and the display may effectively limit the minimum desirable size of the device. Specifically, a relatively large liquid crystal display 115 is deemed preferable and about one-half square inch of front panel area should preferably be allocated to microphone 101 and LED 118. Touch switches 113, 114 are also preferably placed adjacent the display but front panel area which must be allocated to the touch switches is minimal. It is also desirable to provide a gain control 142' for amplifier 102 and the delay adjustment 106' on the front panel.

Power and function switch 108 and one or more auxiliary input plugs 121, 131 141 can advantageously be provided on a side of the timer. A control knob (not shown) for potentiometer 106, preferably in the form of a knurled disk, which need not be manipulated during use, could also be alternatively placed on the side panel to avoid inadvertent movement during use. Incidentally, if desired, especially to save space, switch 108 can be formed as a center-off DPDT switch to control power to the unit as well as controlling whether productive or non-productive time will be accumulated.

Referring to both FIGS. 2 and 3, additional sensors may be advantageously provided either supplementary to or in substitution for microphone 101. Specifically, to allow the use of the device as a study timer, a wide-angle motion sensor 143 can be provided and controlled to act either alone or in combination with the microphone 101 by switch 124. Other sensor devices of many different types can be connected to the timer by one of jacks 121 or 131. It should be noted that jack 121 is arranged to break the connection to microphone whereas jack 131 is not.

If the timer according to the invention is constructed as a stand-alone device, it is deemed preferable that the device be placed in a housing having a depth and height of about one to one and one-quarter inches and a width of about three inches in order to rest on a conventional music stand or music rest of an instrument such as a piano where it can also serve as a page holder. Alternatively, the timer is also preferably provided with a spring clip 123 or other device on the top of the housing to allow the timer to be hung from the shelf of a music stand.

Electronic metronomes are well-known and commercially available and it may be desirable to include the practice timer of the present invention therein. Returning now to FIG. 2, modifications of the basic invention to incorporate the invention into such an electronic metronome will be discussed. It is to be understood, however, that the invention is not limited to embodiment as a stand-alone device or combined with an electronic metronome, but could be included in virtually any device, including maintenance indicators for machinery and the like. For this reason, it is desirable to provide external access to the control of switch 120 such as at jack 141, shown in FIGS. 2 and 3.

With respect to electronic metronomes and any other devices with which the timer according to the invention may be used, the possibility of interference of the function of the timer with the sensor must be considered. For this reason, switch 120 is provided, which is illustrated in FIG. 2 as a field-effect transistor, but can take any desired form. Assuming combination with an electronic metronome, it is to be noted that most such devices are arranged to be able to produce periodic sharp sounds, which may be picked up by the microphone 101. Such an application to an electronic metronome is therefore illustrative of a way in which interference between functions can be avoided, in view of which other arrangements will become clear to those skilled in the art.

In this particular case, a sharp sound or other physical effect may be received by the microphone 101 or other detector structure connected to the timer at plug 121. To avoid the effect of such interference, the electrical output of the electronic metronome, which may be used to generate the sharp sound, is also transmitted to switch 120 to turn the same off for a short interval during which interference could potentially occur. As long as the duration of the interference is shorter than the time constant of the RC delay circuit 16, the turning off of switch 120 to prevent transmission of signals from amplifier 102 to the RC circuit 104 will have no noticeable effect on the operation of the timer circuit other than to avoid false accumulation of time due to interference of a diverse art device with the timer with which the diverse art device may be combined.

In this regard, it is also to be understood that the input to the timer is not to be considered as limited to microphone 101. Other switches can be attached to the timer either in substitution for or in parallel with the microphone. In either embodiment, jacks 121 and 131 can be used to connect one or more additional sensors, as indicated above, which need only function as a switch. Thus, vibration sensors, pendulum switches, photo-conductors and the like can be easily adapted for use with the timer of the invention. However, it has been found that pendulum switch-type vibration sensors are insufficiently sensitive for reliable operation as a practice timer for audible activities, such as piano practice, and it is contemplated that only sensors of energy which can be propagated through the atmosphere, such as sound and/or light, will warrant inclusion within the housing of the device as a permanent part thereof. Sensors such as the above-noted microphone and wide field visible light motion detector arrangements are most preferable for the intended uses as a practice or study timer.

It is also useful for the purpose of expanding the range of applicability of the practice or study timer in accordance with the invention, to provide a switch 124 between sound and optical motion sensors if both are provided in the same housing since it is often desirable to have background music available during study periods. Since motion sensing may be appropriate to practice of some types of activity as well as sound, it may be useful to have both sensors available or to selectively disable one or both sensors as shown by the three position switch 124. This capacity for selective disablement of built-in sensors and the ability to selectively add or substitute other sensors supports a broad range of activities which can be monitored by the invention. It should be understood that the particular form of the switch 124 and jacks 121 and 131 are not critical to the invention and may take many forms, particularly if fewer sensors or types of sensors are to be used. The arrangement shown should be considered as exemplary as allowing the least complicated and economical hardware to accomplish a very broad range of combinations of sensors.

In view of the above, it is seen that the practice timer according to the invention is applicable to a wide range of activities and, in particular, to activities which are somewhat intermittent, to monitor and accumulate the amount of time spent in productive effort in the activity and thus encourage good study and practice habits by discriminating between productive and non-productive periods of the activity. The timer according to the invention can be embodied as a stand-alone unit or combined with other devices such as a metronome which are usable with the activity.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. An activity timer for accumulating elapsed productive time spent engaged in the activity including a sensor means, including means for sensing variation in atmosphere-carried energy, for sensing a result of said activity, a time base means for producing periodic signals, an accumulator means for accumulating said periodic signals from said time base means, a switch means responsive to said sensor means, including a delay means, for interrupting transmission of said periodic signals from said time base to said accumulator means during periods delimited by a predetermined output of said sensor means and a predetermined delay period after another predetermined output of said sensor means.

2. An activity timer as recited in claim 1, wherein said sensor means includes a microphone.

3. An activity timer as recited in claim 1, wherein said sensor means includes a motion sensor.

4. An activity timer as recited in claim 1, wherein said sensor means includes a switch for disabling one or more sensors connected thereto.

5. An activity timer as recited in claim 1, wherein said delay means includes an adjustable delay circuit.

6. An activity timer as recited in claim 1, wherein said sensor means includes a means for interrupting transmission of said periodic signals from said time base to said accumulator means during periods when said sensor means may sense a condition not arising from said activity.

7. An activity timer as recited in claim 1, wherein said switch means interrupts said transmission of said periodic signals from said time base to said accumulator means during periods of sensing a condition arising from said activity and a predetermined time delay thereafter.

8. An activity timer as recited in claim 1, wherein said switch means interrupts said transmission of said periodic signals from said time base to said accumulator means other than during periods of sensing a condition arising from said activity and a predetermined time delay thereafter.

9. A method of measuring time duration of productive effort during an activity including the steps of sensing a predetermined form of energy produced by said productive effort of said activity, establishing a predetermined time period during which productive effort will not produce said predetermined form of energy, and accumulating elapsed time during the sum of a duration of said sensing step and said predetermined time period.

10. In combination with an electronic metronome, a timer including a sensor means, including means for sensing variation in atmosphere-carried energy, for sensing a result of said activity, a time base means for producing periodic signals, an accumulator means for accumulating said periodic signals from said time base means, a switch means responsive to said sensor means, including a delay means, for interrupting transmission of said periodic signals from said time base to said accumulator means during periods delimited by a predetermined output of said sensor means and a predetermined delay period after another predetermined output of said sensor means.

* * * * *

UNITED STATES PATENT AND TRADEMARK OFFICE

CERTIFICATE OF CORRECTION

PATENT NO. : 5,195,061

DATED : March 16, 1993

INVENTOR(S) : Erin M. Curtis

It is certified that error appears in the above—identified patent and that said Letters Patent is hereby corrected as shown below:

On the title page of the printed patent, under "United States Patent [19]", after "Curtis", the first instance, delete --et al.--.

On the title page of the printed patent, after the title, line [76] should read:

"Inventor: Erin M. Curtis, of 9506 Arnon Chapel Rd., Great Falls, VA 22066"

Signed and Sealed this

Twenty-seventh Day of April, 1993

*Attest:*

MICHAEL K. KIRK

*Attesting Officer*

*Acting Commissioner of Patents and Trademarks*